US005735517A

United States Patent [19]

Kanbe et al.

[11] Patent Number: 5,735,517

[45] Date of Patent: Apr. 7, 1998

[54] SHEET FEED MECHANISM AND PRINTER

[75] Inventors: Hideo Kanbe; Kangi Suzuki, both of Shizuoka, Japan

[73] Assignee: Star Micronics Co., Ltd., Shizuoka, Japan

[21] Appl. No.: 579,293

[22] Filed: Dec. 27, 1995

[30] Foreign Application Priority Data

Jan. 13, 1995 [JP] Japan ..... 7-020989

[51] Int. Cl.[6] ..... B65H 5/06

[52] U.S. Cl. ..... 271/273; 271/272

[58] Field of Search ..... 271/272–274

[56] References Cited

U.S. PATENT DOCUMENTS

| | | | |
|---|---|---|---|
| 3,021,134 | 2/1962 | Appell | 271/274 |
| 3,942,785 | 3/1976 | Stange | 271/274 |
| 4,621,802 | 11/1986 | Ishida et al. | 271/272 |
| 5,040,781 | 8/1991 | Matoba | 271/272 |

FOREIGN PATENT DOCUMENTS

| | | | |
|---|---|---|---|
| 0175640 | 10/1982 | Japan | 271/274 |
| 0165252 | 7/1988 | Japan | 271/272 |
| 0272733 | 11/1988 | Japan | 271/272 |
| 403186539 | 8/1991 | Japan | 271/272 |
| 405229689 | 9/1993 | Japan | 271/272 |

*Primary Examiner*—H. Grant Skaggs

*Attorney, Agent, or Firm*—Pollock, Vande Sande & Priddy

[57] ABSTRACT

The present invention provides a sheet feed mechanism capable of accurately feeding a sheet and of preventing a skew of a sheet, and a printer provided with the same sheet feed mechanism. The sheet feed mechanism comprises a drive shaft, a plurality of driving rollers rotatably mounted on the drive shaft for feeding a sheet, such as a slip, and a single driven roller rotatably disposed so as to press the sheet against the driving rollers. The driven roller has a working surface for pressing the sheet against the driving rollers, corresponding to the plurality of driving rollers.

4 Claims, 6 Drawing Sheets

SHEET FEED MECHANISM AND PRINTER

BACKGROUND OF THE INVENTION

1. Field of the Invention

The present invention relates to a sheet feed mechanism for feeding a sheet, such as a slip, and a printer provided with the same sheet feed mechanism.

2. Description of the Prior Art

Conventionally there is a slip printer which prints characters on a sheet such as a slip as disclosed in JP-U No. 62-150148 and JP-Y 2-8781.

When printing characters on a slip by a printer of such a type, the slip is fed to the printing unit by a sheet feed mechanism having a pair of rollers. Therefore, the slip is liable to be fed obliquely.

Referring to FIG. 6 showing the prior art sheet feed mechanism, driving rollers 102 and 104 are mounted on a drive shaft 100, and driven rollers 108 and 110 are mounted on a support shaft 106 so as to correspond to the driving rollers 102 and 104, respectively. Torque is transmitted to the drive shaft 100 through a gear train, not shown, and a gear 112 attached to the drive shaft 100 to feed a slip 114 by the sheet feed mechanism.

There are possible feed results of the slip 114 as shown in FIG. 7: a correct feed a, a rightward skew b, and a leftward skew c.

Such skew is inferred to be caused by the individual rotation of the driving rollers 102 and 104 and the driven rollers 108 and 108, the difference between the respective radii R1 and R2 (R1≠R2) of the driven rollers 108 and 110, and/or the difference between the respective pressures P1 and P2 (P1≠P2) of the driving rollers 102 and 104, which are formed of an elastic material, on the slip 114. Although the effects of those causes of skew may be reduced, it is impossible to remove the effects completely, and there is a limit in making the radii R1 and R2 and/or the pressures P1 and P2 accurately equal to each other especially in case of the driving rollers 102 and 104 of small radii.

Detection of the skew of the slip 114 and troublesome control and adjusting operations including changing the rotating speeds between the right and left rollers are necessary to correct the skew of the slip 114. It is practically impossible to incorporate such measures into a small printer and, even if mechanically possible, the use of such measures increases the costs of the printer.

SUMMARY OF THE INVENTION

Accordingly, it is an object of the present invention to provide a sheet feed mechanism capable of accurately feeding a sheet and of preventing a skew of a sheet, and to provide a printer provided with the same sheet feed mechanism.

As shown in FIG. 1, a sheet feed mechanism (2) in accordance with the present invention comprises a drive shaft (10), a plurality of driving rollers (4, 6) rotatably mounted on the drive shaft (10) for feeding a sheet (slip) (14), and a single driven roller (8) rotatably disposed so as to press the sheet (14) against the driving rollers (4, 6), in which the driven roller (8) has a working surface for pressing the sheet (14) against the driving rollers (4, 6), corresponding to the plurality of driving rollers (4, 6).

This sheet feed mechanism has the single driven roller having the working surface corresponding to the driving rollers. The driven roller may be of uniform diameter and hence the rotating speed of the working surface of the driven roller is uniform through any point on its working surface. When the driving roller presses the sheet against the working surface of the driven roller to transmit its torque to the driven roller to feed the sheet, a paper skew is prevented since the driven roller is a single member so that the working surface is uniformly rotated. Even if the driving rollers are of different diameters, the sheet will not be obliquely fed, provided that the driving rollers are pressed closely against the working surface of the driven roller. This skew preventing action is effective also when a single driven roller having a plurality of working surfaces is used.

In the sheet feed mechanism of the present invention, the working surfaces of the driven roller can be formed by forming a recessed portion, which does not contact the sheet, on a single roller member, and the working surfaces thus formed respectively corresponding to the driving rollers prevent paper skew.

In the sheet feed mechanism of the present invention, the driven roller may be formed by mounting a plurality of rollers to a support shaft (17) and then integrating them into a single roller member so that the plurality of rollers correspond to the driving rollers, respectively, to prevent paper skew.

A printer provided with this sheet feed mechanism (2) prevents paper skew and is capable of reliable sheet feeding operation and of improving print quality.

The printer comprises a fixed frame (22), a swing frame (26) and a pressing mechanism, and the driving rollers and the driven roller are mounted on the fixed and the swing frame so as to be disposed opposite to each other, and pressed against each other by the pressing mechanism. Therefore, the printer is capable of preventing paper skew and improved sheet feeding accuracy.

DETAILED DESCRIPTION OF THE PREFERRED EMBODIMENTS

Figure 1:
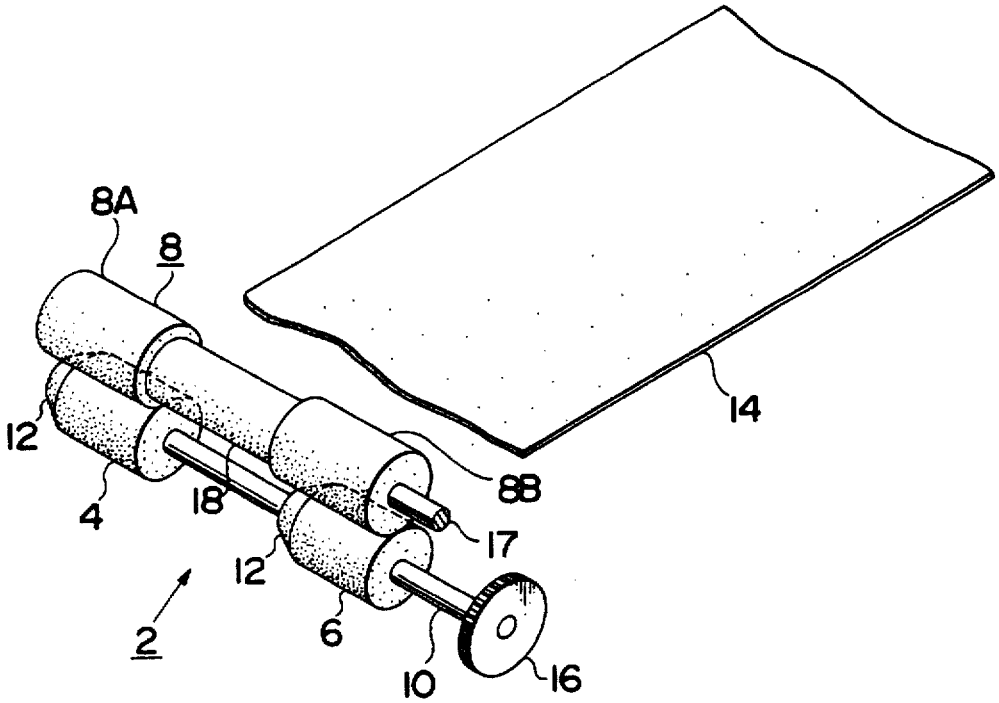
FIG. 1 is a perspective view of a sheet feed mechanism in a preferred embodiment according to the present invention.

Referring to FIG. 1, a sheet feed mechanism 2 in a preferred embodiment according to the present invention comprises a pair of driving rollers 4 and 6, and a single driven roller 8 disposed in combination with the driving rollers 4 and 6. The driving rollers 4 and 6 are mounted at a set interval on a drive shaft 10 supported in bearings, not shown. A taper surface 12 is formed at one end of each of the driving rollers 4 and 6 to facilitate the insertion of a sheet 14, such as a slip, between the driving rollers 4 and 6, and the driven roller 8. A gear 16 is attached to the drive shaft 10 and the output torque of a motor or the like, i.e., a driving source, is transmitted to the gear 16.

The driven roller 8 is attached to a support shaft 17 supported with its axis in parallel to that of the drive shaft 10. The driven roller 8 is an integral member formed of a synthetic resin or the like and having working surfaces 8A and 8B respectively corresponding to the driving rollers 4 and 6 and a recessed portion 18, which does not contact the sheet 14, disposed between the working surfaces 8A and 8B. When the sheet feed mechanism 2 is provided with three or more driving rollers, the driven roller 8 may be provided with three or more working surfaces. The driven roller 8 may be provided with a single working surface corresponding to the two driving rollers 4 and 6.

Figure 2:
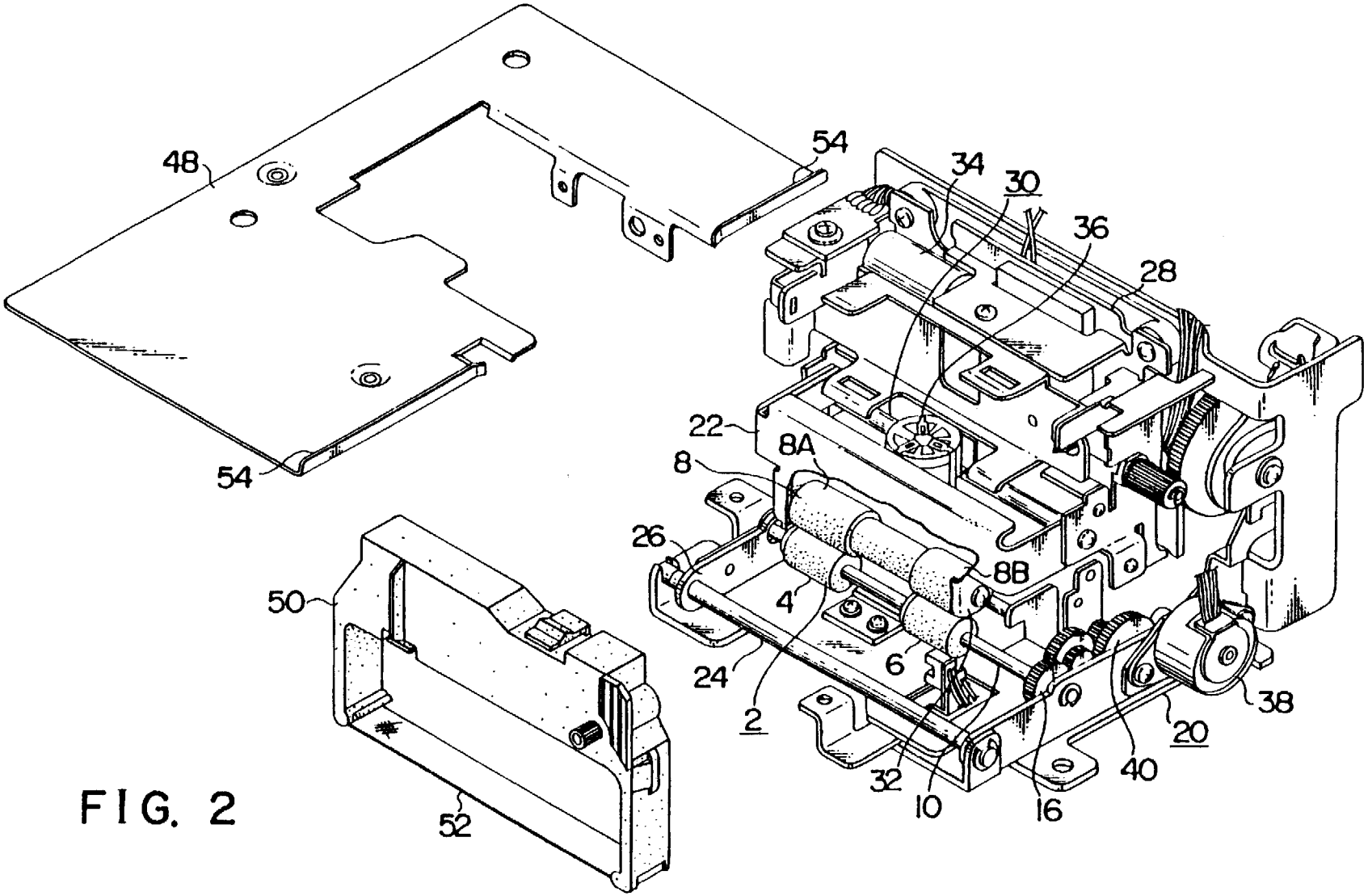
FIG. 2 is an exploded perspective view of a printer provided with the sheet feed mechanism of FIG. 1.
Figure 3:
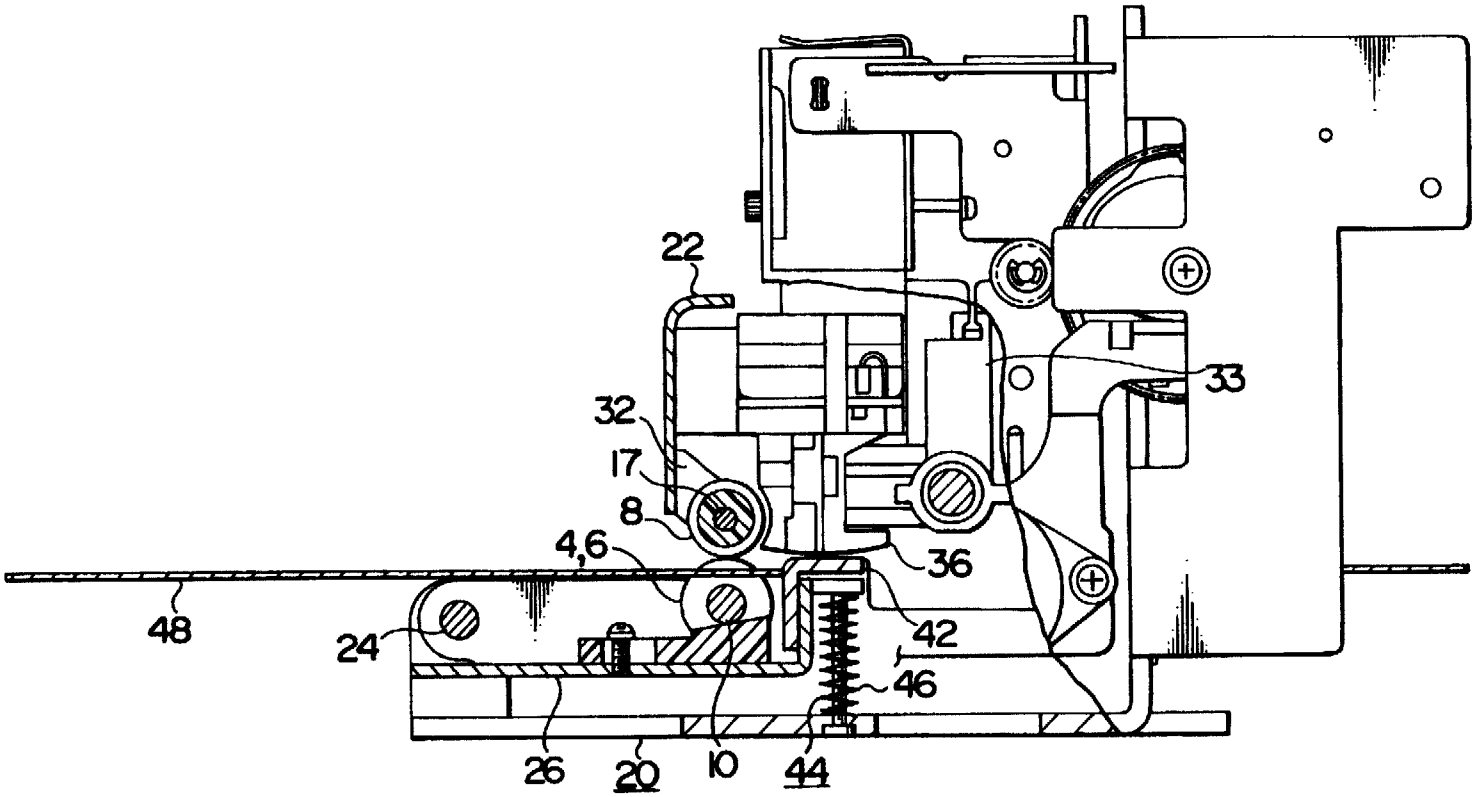
FIG. 3 is a sectional view of the printer of FIG. 2, showing a pressing mechanism for pressing driving rollers and a driven roller against each other.

Referring to FIGS. 2 and 3, a slip printer in a preferred embodiment according to the present invention is provided with the sheet feed mechanism 2. The slip printer has a substantially L-shaped chassis 20, a fixed frame 22, and a swing frame 26 supported by a support shaft 24 on the front end of the chassis 20. A printed wiring board 28 and a carriage mechanism 30 are attached to the fixed frame 22, and the driven roller 8 is supported for rotation on a bearing unit 32. The carriage mechanism 30 is provided with a carriage motor 34 for driving a carriage 33 carrying a print head 36.

A feed motor 38, a gear mechanism 40 and a platen 42 are mounted on the swing frame 26. The driving rollers 4 and 6 are mounted on the drive shaft 10, and a torque is transmitted through the gear mechanism 40 to the drive shaft 10. The driven roller 8 is disposed in combination with the driving rollers 4 and 6 in a position as shown in FIG. 1. In FIGS. 1, 2 and 3, like or corresponding parts are designated by the same reference characters. The drive shaft 10 and the driving rollers 4 and 6 supported on the swing frame 26, and the driven roller 8 supported on the fixed frame 22 constitute the sheet feed mechanism 2.

As shown in FIG. 3, a pressing mechanism 44 for pressing the driving rollers 4 and 6 and the driven roller 8 against each other is disposed between the chassis 20 and the swing frame 26. A compression spring 46 is extended between the swing frame 26 and the chassis 20 to bias the swing frame upward so that the driving rollers 4 and 6 are pressed against the working surfaces 8A and 8B of the driven roller 8 with a slip 14 inserted there between.

A guide plate 48 is mounted on the chassis 20 so as to extend in a space between the fixed frame 22 and the swing frame 26 to guide the slip 14 to the nip line between the driving rollers 4 and 6, and the working surfaces 8A and 8B of the driven roller 8. An ink ribbon cassette 50 is mounted on the fixed frame 22. An ink ribbon 52 is inserted through the space between the driving rollers 4 and 6 and the driven roller 8 in a space between the print head 36 and the platen 42 so as to be located between the print head 36 and the slip 14.

The operation of the sheet feed mechanism 2 on this printer will be described hereinafter. The slip 14 is placed on the guide plate 48 with its right edge, as viewed in FIG. 2, in contact with stoppers 54 formed on the guide plate 48. Upon the start of printing operation, the slip 14 is fed by the rotation of the driving rollers 4 and 6.

Figure 4:
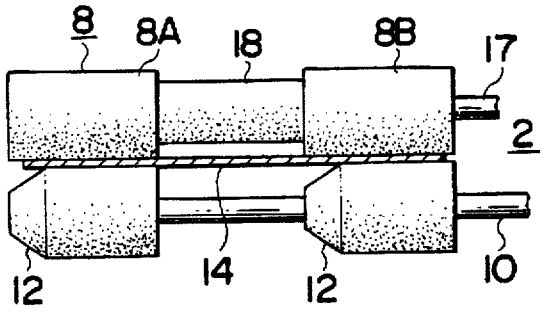
FIG. 4 is a front view of the sheet feed mechanism of FIG. 1 in sheet feeding operation.
Figure 5:
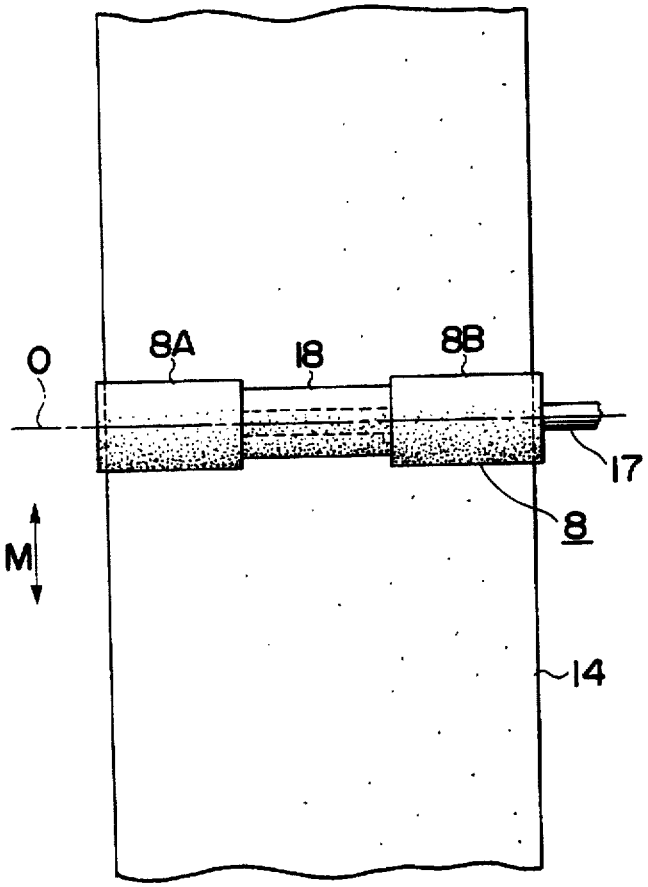
FIG. 5 is a plan view of the sheet feed mechanism of FIG. 1 in sheet feeding operation.
Figure 6:
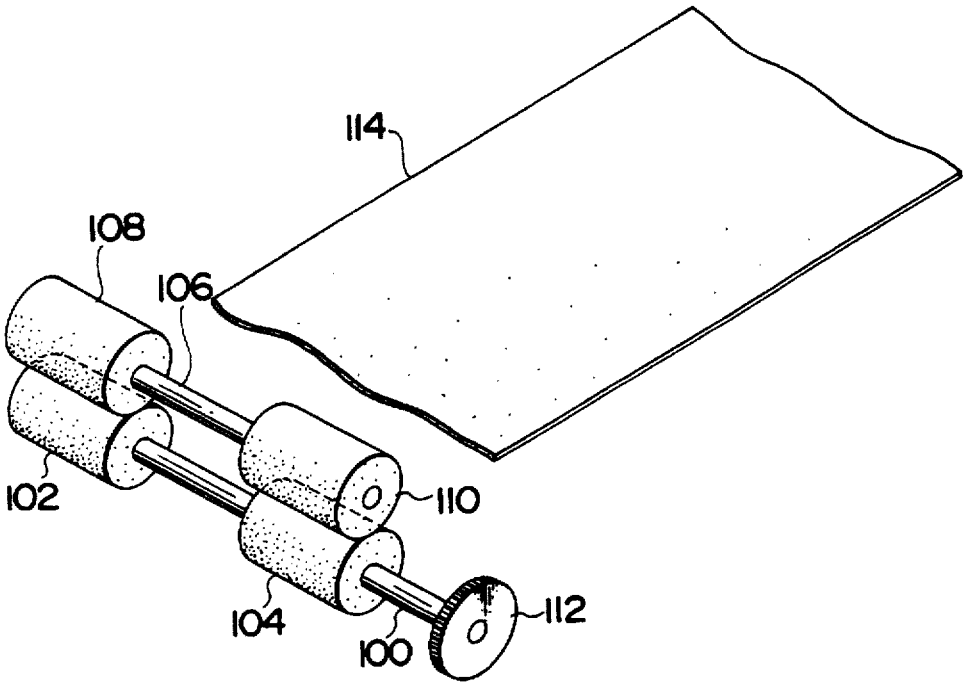
PRIOR ART FIG. 6
FIG. 6 is a perspective view of a prior art sheet feed mechanism.
Figure 7:
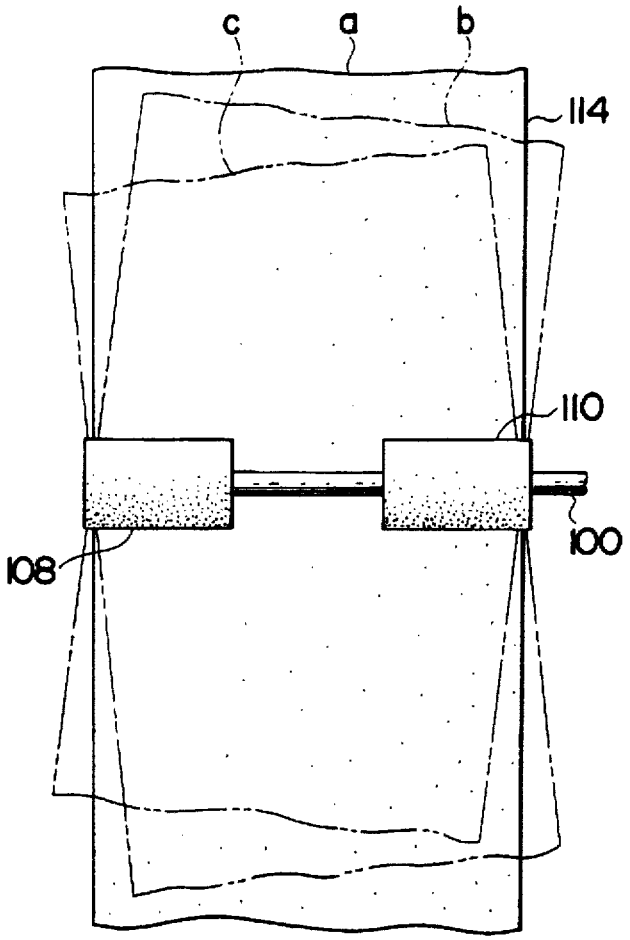
PRIOR ART FIG. 7
FIG. 7 is a plan view of the sheet feed mechanism of FIG. 6 in sheet feeding operation.
Figure 8:
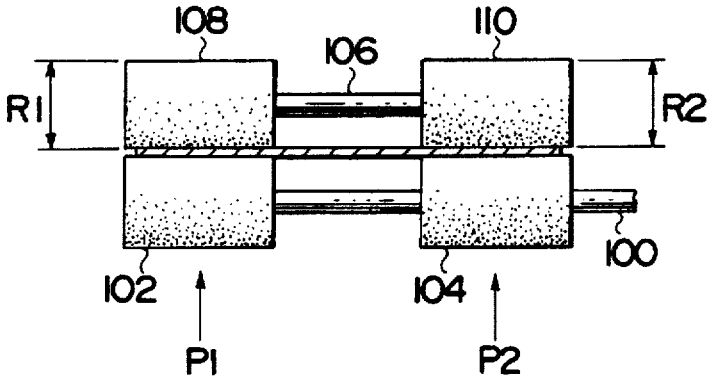
PRIOR ART FIG. 8
FIG. 8 is a front view of the sheet feed mechanism of FIG. 6 in sheet feeding operation.

Referring to FIGS. 4 and 5 showing the slip 14 undergoing feed operation, the driving rollers 4 and 6 are pressed against the working surfaces 8A and 8B of the driven roller 8 to apply the frictional driving force of the driving rollers 4 and 6 to the slip 14. Since the driven roller 8 is provided integrally with the working surfaces 8A and 8B, and the working surfaces 8A and 8B rotate at the same rotating speed, the slip 14 is fed without a skew in a direction of the arrow M perpendicular to the axis O of the driven roller 8.

When the slip 14 is fed correctly, characters can be correctly printed at predetermined positions on the slip 14 and a paper jam is also prevented.

Although the driven roller is supported on the fixed frame and the driving rollers are supported on the swing frame in this embodiment, the driving rollers and the driven roller may be supported on the fixed frame and the swing frame, respectively.

Although the invention has been described as applied to a slip printer, the present invention is applicable to printers other than the slip printer.

Although the invention has been described as applied to a sheet feed mechanism, the present invention is applicable not only to sheet feed mechanisms but also to sheet ejecting mechanisms.

As is apparent from the foregoing description, the present invention has the following effects.

a. The sheet feed mechanism does not require any troublesome work for control and adjustment including the adjustment of torque and the detection of paper skew, it has a very simple construction and is capable of preventing paper skew.

b. The single driven roller integrally provided with the working surface corresponding to the plurality of driving rollers is very simple in construction, inexpensive and capable of preventing paper skew.

c. The sheet feed mechanism can be incorporated into a printer, such as a slip printer, to stabilize the sheet feed operation of the printer.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A sheet feed mechanism for feeding a sheet to be printed by a primer comprising:

driving rollers rotatable in response to applied torque and including a plurality of roller members attached to a drive shaft located at right angles to a sheet feed direction, the drive shaft transmitting the torque from a driving source to the driving rollers, each of the roller members having a working surface which is narrower than a length of the drive shaft and being attached to the drive shaft with a predetermined axial space therebetween;

a driven roller having a single roller member including a plurality of sheet clamping working surfaces and a single intermediate recessed portion, each of the clamping working surfaces being arranged with a predetermined length corresponding to the working surfaces of the driving rollers;

the driven roller member mounted an a support shaft positioned parallel spaced relation to the drive shaft.

2. The mechanism set forth in claim 1 wherein the driven roller member has the same diameter at each working surface thereof.

3. A sheet feed mechanism for feeding a sheet to be printed by a printer comprising:

driving rollers rotatable in response to applied torque and including a plurality of roller members attached to a drive shaft located at right angles to a sheet feed direction, the drive shaft transmitting the torque from a driving source to the driving rollers, each of the roller members having a working surface which is narrower than a length of the drive shaft and being attached to the drive shaft with a predetermined axial space therebetween;

a driven roller having a single roller member including a plurality of sheet clamping working surfaces and a single intermediate recessed portion, each of the clamping working surfaces being arranged with a predetermined length corresponding to the working surfaces of be driving rollers;

the driven roller member mounted on a support shaft positioned in parallel spaced relation to the drive shaft;

confronting swing and fixed frames for correspondingly mounting the driving rollers and fie driven roller; and means connected to fie frames for pressing the driven roller and driving rollers together.

4. The mechanism set forth in claim 3 wherein the driven roller member has the same diameter at each working surface thereof.

* * * * *